United States Patent [19]

Ostrowsky

[11] Patent Number: 4,776,501

[45] Date of Patent: Oct. 11, 1988

[54] SELF-CLOSING, PRESS-TO-OPEN, DISPENSING CLOSURE

[75] Inventor: Efrem M. Ostrowsky, Highland Park, Ill.

[73] Assignee: Seaquist Closures, Crystal Lake, Ill.

[21] Appl. No.: 91,542

[22] Filed: Aug. 31, 1987

[51] Int. Cl.[4] ..... B67D 3/00

[52] U.S. Cl. ..... 222/517; 222/534; 222/556; 215/235

[58] Field of Search ..... 222/511, 513, 517, 518, 222/526, 533–534, 545, 556; 220/292, 335, 339; 215/235, 237–238

[56] References Cited

U.S. PATENT DOCUMENTS

| | | | |
|---|---|---|---|
| 1,173,546 | 2/1916 | Baron | 222/472 |
| 1,861,602 | 6/1932 | Koze | 222/517 |
| 2,272,867 | 2/1942 | Cobel | 222/473 |
| 2,312,380 | 3/1943 | Bernhardt | 222/517 |
| 2,391,345 | 4/1943 | Punte | 222/517 |
| 2,501,653 | 3/1950 | Boak | 222/83.5 |
| 2,574,422 | 11/1951 | Stoos, Jr. et al. | 222/517 |
| 2,575,106 | 11/1951 | Hermani | 222/517 |
| 2,694,511 | 11/1954 | Bogeaus et al. | 222/491 |
| 2,808,183 | 10/1957 | Olson | 222/498 |
| 3,157,322 | 11/1964 | Bernhardt | 222/517 |
| 3,187,965 | 6/1965 | Bourget | 222/518 |
| 3,201,011 | 8/1965 | Brocken | 222/473 |
| 3,252,632 | 5/1966 | Hagenes | 222/517 X |
| 3,300,104 | 1/1967 | Burt | 222/482 |
| 3,400,866 | 9/1968 | Fattori | 222/511 |
| 3,516,581 | 6/1970 | Micallef | 222/529 |
| 3,853,250 | 12/1974 | Alpern | 222/517 |
| 4,158,902 | 6/1979 | Chernack et al. | 220/335 X |
| 4,219,138 | 8/1980 | Hazard | 222/534 |
| 4,220,248 | 9/1980 | Wilson et al. | 215/235 |
| 4,291,818 | 9/1981 | Nozawa | 220/335 |
| 4,343,397 | 8/1982 | Nozawa | 206/37 |
| 4,371,095 | 2/1983 | Montgomery | 222/153 |
| 4,377,247 | 3/1983 | Hazard | 222/517 |
| 4,399,928 | 8/1983 | Klingler | 220/335 |
| 4,441,637 | 4/1984 | Libit | 222/556 |
| 4,487,342 | 12/1984 | Shy | 222/481.5 |
| 4,579,260 | 4/1986 | Young et al. | 222/511 X |
| 4,625,898 | 12/1986 | Hazard | 222/517 |
| 4,645,086 | 2/1987 | Rosenthal | 215/335 |

FOREIGN PATENT DOCUMENTS

| | | | |
|---|---|---|---|
| 2120079 | 11/1972 | Fed. Rep. of Germany | 222/402.11 |
| 4771 | 12/1876 | United Kingdom | 222/517 |

OTHER PUBLICATIONS

Photographs labeled "A" through G, each showing three closure specimens.

Seaquist Closures Publication (2 sides) C-044/5M entitled "DISC TOP ® Dispensing Closures", 1986.

*Primary Examiner*—Michael S. Huppert

*Attorney, Agent, or Firm*—Dressler, Goldsmith, Shore, Sutker & Milnamow, Ltd.

[57] ABSTRACT

A press-to-open dispensing closure is provided for the mouth of a container. It includes a closure body and a nozzle assembly carried by the closure body. The closure body has a deck extending across a portion of the container top, and the deck defines a port through which communication with the container interior is established. The nozzle assembly includes a forwardly projecting dispensing nozzle and a rearwardly projecting actuating member above the deck. The nozzle assembly is pivotably supported in the closure body to accommodate pivoting movement between an open and a closed position. In one embodiment, spring members are provided on the closure body and project upwardly for resiliently biasing the nozzle assembly toward the closed position.

1 Claim, 4 Drawing Sheets

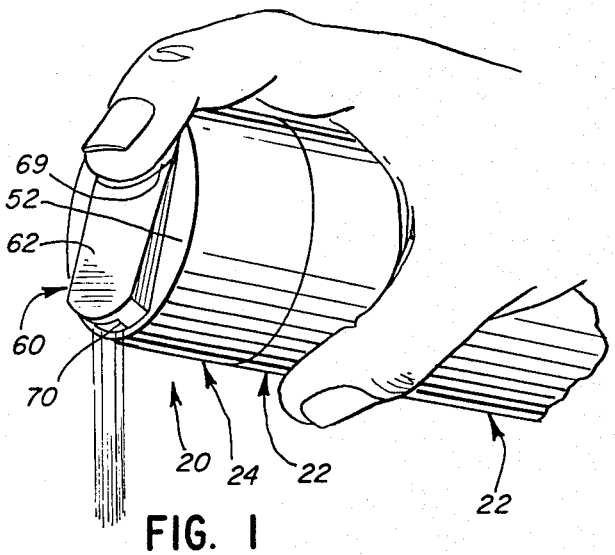
FIG. 1
FIG. 2
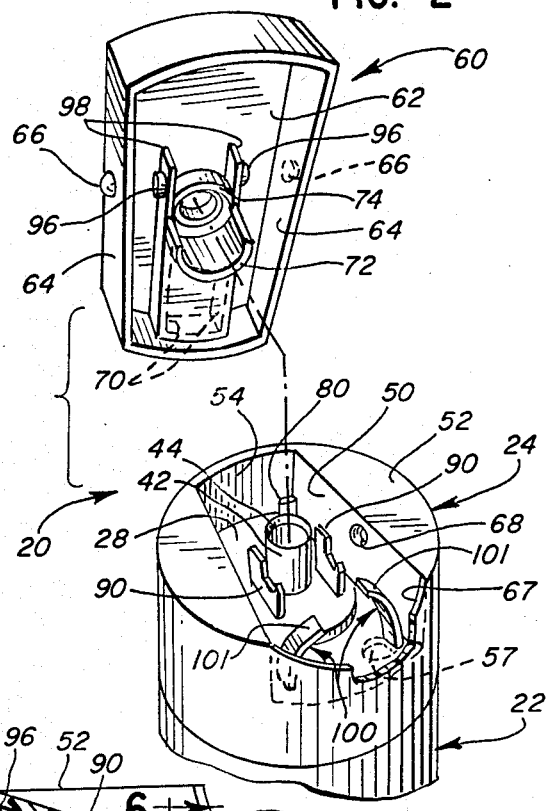
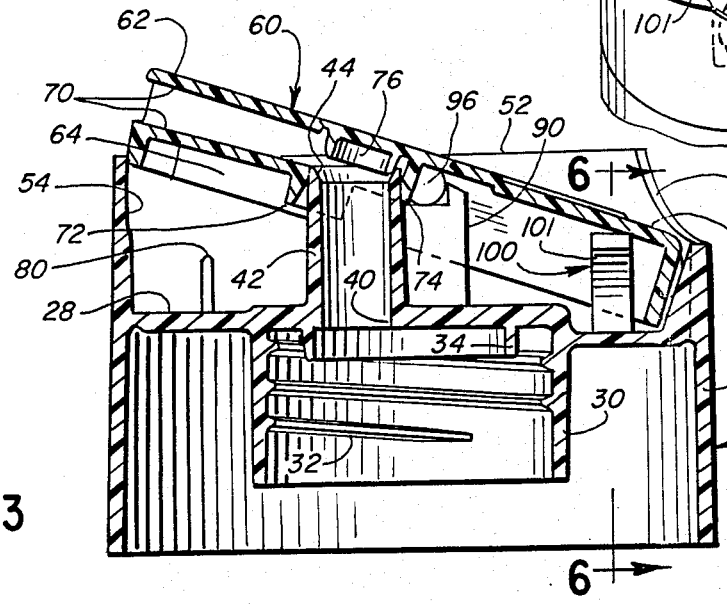
FIG. 3
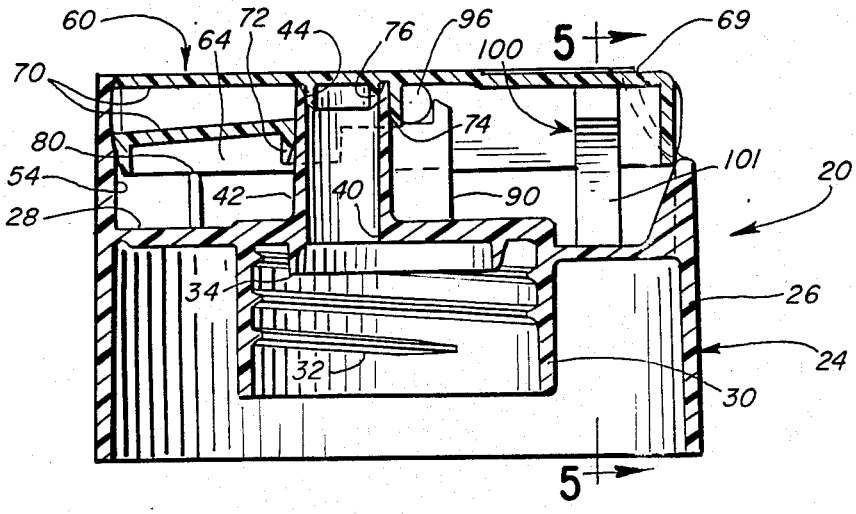
FIG. 4

FIG. 12
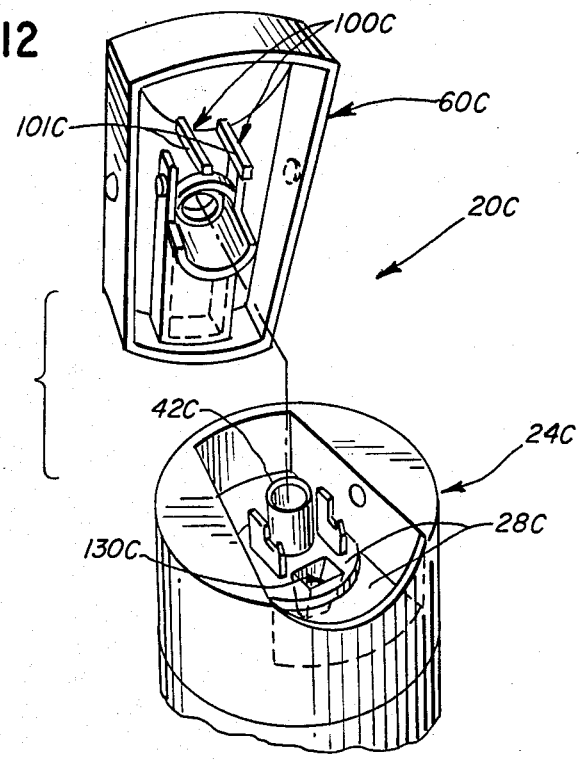
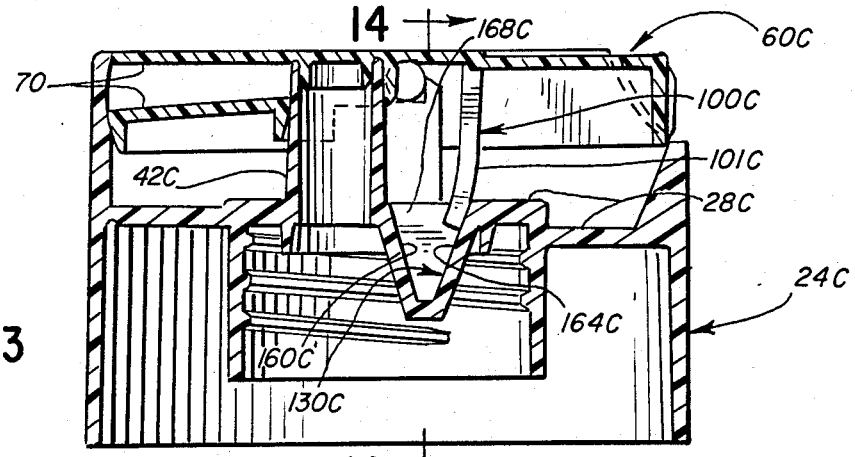
FIG. 13
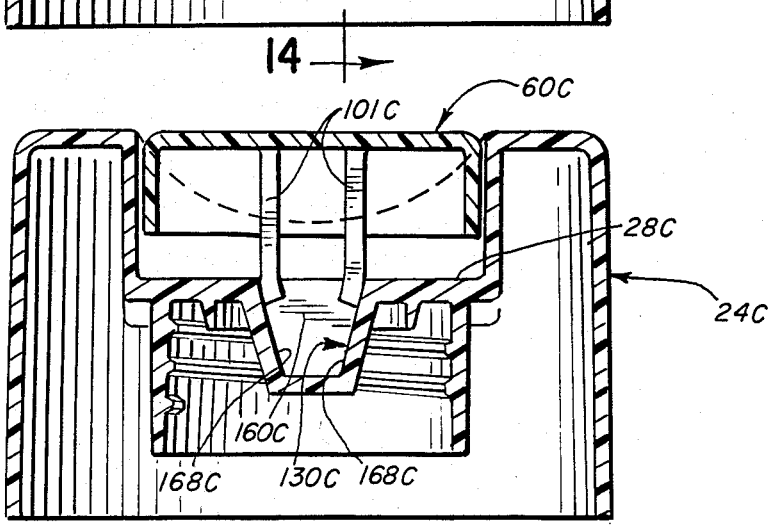
FIG. 14

SELF-CLOSING, PRESS-TO-OPEN, DISPENSING CLOSURE

TECHNICAL FIELD

This invention relates to closures for containers, and more particularly to a press-to-open type closure from which the container contents may be dispensed.

BACKGROUND OF THE INVENTION AND TECHNICAL PROBLEMS POSED BY THE PRIOR ART

Designs have been proposed for containers used with flowable substances wherein a closure is provided for being attached to the container mouth and wherein the closure includes a flip-up spout or nozzle assembly for dispensing the container contents. See, for example, U.S. Pat. Nos. 4,645,086 and 3,516,581.

Although the designs for the closures disclosed in the above-discussed patents may function well for the purposes for which they were designed, the commercial embodiments of such closures must be manually closed. It has occurred to the inventor of the present invention that certain improved structural and operational features would be desirable in many applications.

Specifically, it may be advantageous in some applications to provide a closure with means for urging the closure components to a closed position so as to occlude the flow of the contents through the nozzle assembly.

Further, it would be desirable if such closing means could be operable upon simple release or removal of the manual opening force.

Additionally, it would be beneficial if the closing means in such an improved dispensing closure could be completely hidden in the closure so as not to be visible from the exterior of the closure and so as to be protected from the exterior environment.

Finally, it would be advantageous if the means for effecting this self-closing operation included structural components that could be readily fabricated, preferably by molding the components from thermoplastic materials as a unitary closure structure.

SUMMARY OF THE INVENTION

A self-closing, press-to-open, dispensing closure is provided for a container for flowable material.

The closure includes a closure body for the top of the container and a nozzle assembly carried by the closure body. The closure body has means for mounting the closure body on the container and has a deck for extending across at least a portion of the container top. The deck defines a port through which communication with the container interior is established.

The nozzle assembly includes a forwardly projecting dispensing nozzle and a rearwardly projecting actuating member above the deck.

Pivot means are provided for pivotably supporting the nozzle assembly about a pivot axis above the deck to accommodate pivoting movement of the nozzle assembly about the pivot axis between a closed position occluding the flow of the material into the nozzle from the port and an open position permitting flow of the material out of the port and through the nozzle.

A biasing means is carried by, and connected to only, either the nozzle assembly or the closure body for resiliently biasing the nozzle assembly to the closed position.

Numerous other features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same, FIG. 1 is a fragmentary, perspective view of the closure of the present invention shown on a container with the closure being operated to dispense flowable material from the container;

FIG. 2 is a fragmentary, exploded perspective view of the closure on the container;

FIG. 3 is an enlarged, cross-sectional view of the closure in the open position;

FIG. 4 is a cross-sectional view similar to FIG. 3 but showing the closure in the closed position;

FIG. 12 is a fragmentary, exploded perspective view of a fourth embodiment of the closure of the present invention;

FIG. 13 is a cross-sectional view similar to FIG. 4, but showing the fourth ebodiment of the closure in the closed position; and FIG. 14 is a cross-sectional view of the fourth embodiment taken along the plane 14—14 in FIG. 13.

DESCRIPTION OF THE PREFERRED EMBODIMENTS

Figure 5:
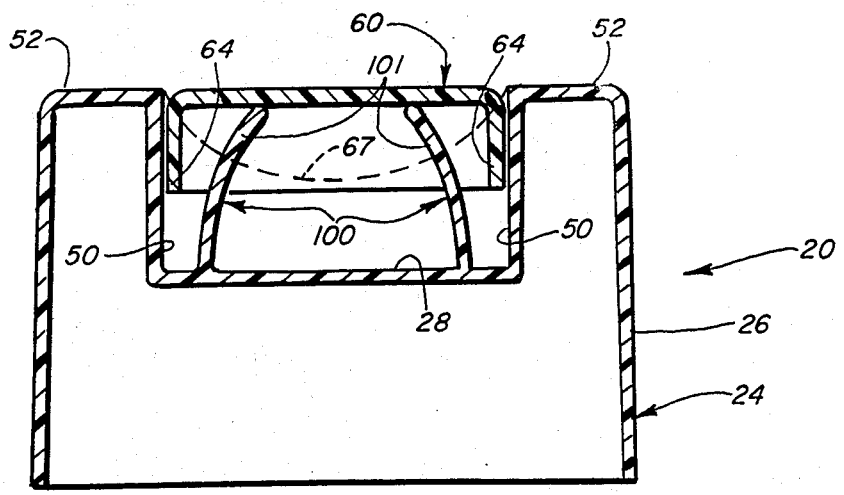
FIG. 5 is a cross-sectional view taken along the plane 5—5 in FIG. 4.

While this invention is susceptible of embodiment in many different forms, this application and the accompanying drawings disclose only some specific forms as examples of the use of the invention. The invention is not intended to be limited to the embodiments so described, and the scope of the invention will be pointed out in the appended claims.

For ease of description, the closure of the invention is described in a position as it is usually encountered--upright on a container, and terms such as upper, lower, horizontal, etc., are used with reference to this position. It will be understood, however, that the closure of this invention may be manufactured, stored, transported, used, and sold in an orientation other than the position described.

A first embodiment of the dispensing closure of the present invention is illustrated in FIGS. 1–7 wherein the closure is represented generally by reference numeral 20. The closure 20 is adapted to be mounted on a container 22 which may have a conventional open mouth defined by a neck or other suitable structure (not visible in the Figures).

As best illustrated in FIGS. 2–4, the closure 20 includes a closure body 24 for securement to the container 22. In the illustrated embodiment, the closure body 24 includes a generally circular or cylindrical peripheral wall 26 and a generally transverse closure wall or deck 28 across at least a portion of the top of the container 22.

As best illustrated in FIGS. 3 and 4, the interior of the closure body 24 includes a reduced diameter cylindrical wall 30 which is adapted to engage the outer periphery of the top of the container 22 around the container mouth with threads 32. Other suitable engaging means (e.g., snap-fit beads) may be provided to releasably secure the closure body 24 on the container 22. Alternatively the closure body 24 may be non-releasably attached to, or formed unitary with, the container 22.

An annular sealing ring 34 may be provided as best illustrated in FIGS. 3 and 4, for engaging an interior edge of the container 22 at the container mouth for effecting a tight seal.

The closure body 24 includes a port 40 as best illustrated in FIGS. 3 and 4. In the preferred embodiment, as best illustrated in FIGS. 2–4, the closure body 24 includes a discharge tube 42 projecting upwardly from the deck 28. The tube 42 communicates through the deck 28 with the container interior at the lower end of the tube 28 through the port 40. The upper end of the tube defines a discharge opening 44.

As best illustrated in FIGS. 2 and 5, the closure body 24 includes a pair of spaced-apart sidewalls 50 which extend upwardly from the deck 28. The sidewalls 50 terminate in a horizontal top surface 52.

The closure body 24 also includes an upwardly projecting end wall 54 (FIGS. 2–4) which projects upwardly from the deck 28 to the top surface 52.

The deck 28 is seen, in the first embodiment illustrated in FIGS. 2–7, to have a recessed orientation with respect to the closure body top surface 52. Further, it is seen that the deck 28 may be characterized as having a generally planar configuration that is not coextensive with the cylindrical outer periphery of the closure body 24.

If the closure body 24 is to be molded from a thermoplastic material, then the deck 28 may include a hole 57 (shown only in phantom in dashed lines in FIG. 2) to facilitate such molding. One or more such holes 57 may be provided depending upon the molding technique employed.

The closure body 24 receives a nozzle assembly 60 as best illustrated in FIGS. 1–5. The nozzle assembly 60 includes a top wall 62 and a pair of spaced-apart flanges 64. Each flange 64 includes a projecting hemispherical perturberance or pivot member 66 (FIG. 2), and these pivot members 66 cooperate with the closure body walls 50 for mounting the nozzle assembly 60 in the closure body 24. In particular, each vertical wall 50 in the closure body 24 defines a mating hemisperical recess 68 (FIG. 2) for snap receipt of one of the pivot members 66 to accommodate pivoting movement of the nozzle assembly 60 about a pivot axis defined by the pivot members 66 and the receiving recesses 68.

When the nozzle assembly 60 is pivotally mounted to the closure body 24, the nozzle assembly 60 can be pivoted (so that the forward end is exposed above the closure body top surface 52) by pushing downwardly (as best illustrated in FIG. 1) on the rear portion of the nozzle assembly 60. To this end, the nozzle assembly 60 includes a rearwardly projecting actuating portion or member 69 which may be a continuation of the top wall 62. However, as illustrated in FIGS. 2 and 3, the actuating member portion 69 is preferably fabricated so that the top surface of the actuating member 69 is somewhat below the surface of the top wall 62 so as to identify a region which may be conveniently pressed with one's finger. Further, to accommodate the downward pressing of the actuating member 69, the rear portion of the closure body 24 is cut away as indicated at 67.

The nozzle assembly 60 includes a structure on the undersurface of the nozzle top wall 62 for either conducting the flowable material from the container discharge tube 42 or for occluding flow out of the discharge tube 42—depending upon the orientation of the nozzle assembly 60. In particular, the nozzle assembly 60 includes a forwardly projecting nozzle or channel 70 which merges with, and opens into, a generally cylindrical sealing wall which has a long, semi-cylindrical portion 72 adjacent the forward side of the discharge tube 42 and which has a shorter, semi-cylindrical portion 74 adjacent the rearward side of the discharge tube 42.

The semi-cylindrical portions 72 and 74 surround and seal the upper end of the discharge tube 42 when the nozzle assembly 60 is in the closed position as illustrated in FIG. 4. When the nozzle assembly 60 is tilted to the dispensing position as illustrated in FIG. 3, the semi-cylindrical portions 72 and 74 still continue to seal the outer periphery of the upper end of the discharge tube 42 so that the contents, while being dispensed into the nozzle 70, cannot leak out around the top of the discharge tube 42.

Preferably, a sealing plug 76 projects downwardly from the underside of the nozzle assembly top wall 62. The sealing plug 76 has a generally cylindrical or annular configuration and is adapted to enter into the opening 44 at the top of the discharge tube 42 to sealingly occlude the discharge tube 42 when the nozzle assembly 60 is in the closed position as illustrated in FIG. 4. On the other hand, when the nozzle assembly 60 is tilted to the dispensing position as illustrated in FIG. 3, the front portion of the sealing plug 76 is tilted away from the top of the discharge tube 42 to permit flow of the material out of the discharge opening 44 and through the dispensing nozzle 70.

In the closed position, the forward end of the nozzle assembly 60 is prevented from being tilted downwardly beyond the generally horizontal orientation illustrated in FIG. 4. To this end, a bearing flange 80 (FIGS. 2–4) projects upwardly from the deck 28 adjacent each sidewall 50. The top of each bearing flange 80 bears against the bottom edge corresponding flange 64 of the nozzle assembly 60. This prevents the nozzle assembly 60 from being tilted forwardly below the position illustrated in FIG. 4.

Interior structures are provided in the enclosure 20 for additionally supporting the nozzle assembly 60 in the closure body 24. In particular, the closure body 24 includes a pair of spaced-apart bearing walls 90 (FIGS. 2–4). The bearing walls 90 are located on either side of the discharge tube 42. The top of each bearing wall 90 is notched to function as a bearing surface for receiving a curved journal segment 96 that is formed in the nozzle assembly 60.

Two such journal segments 96 are provided on the underside of the nozzle assembly 60. Each journal segment 96 projects from rearwardly extending walls 98 (FIG. 2) on either side of the nozzle 70. Each journal segment 96 bears against the upwardly facing surface of the notch in the corresponding bearing wall 90 when the nozzle assembly 60 is in the closed position (FIG. 4) as well as when the nozzle assembly 60 is in the open position (FIG. 3). This serves to prevent the hemispherical pivot members 66 of the nozzle assembly 60 from being inadvertently dislocated from the corresponding recesses 68 in the walls 50 of the closure body 24.

In accordance with the principles of the present invention, the nozzle assembly 60 is continuously urged to the closed position illustrated in FIG. 4. To this end, a biasing means 100 is provided for being carried by the nozzle assembly 60 or by the enclosure body 24. In the first embodiment illustrated in FIGS. 1–4, the biasing means 100 is carried by the closure body 24.

In particular, the biasing means 100 includes a pair of spaced-apart, curved members 101 projecting upwardly from the closure body deck 28. Each of the curved members 101 has a free distal end curving inwardly toward the other of the curved members 101. As best illustrated in FIGS. 3 and 4, the inwardly curving free end of each member 101 of the biasing means 100 engages a bearing surface portion of the underside of the nozzle assembly 60 at a point that is rearwardly of the pivot axis defined by the pivot members 66.

When the actuating member or portion 69 of the nozzle assembly 60 is depressed as illustrated in FIGS. 1 and 3, the ends of the curved members 101 of the biasing means 100 are forced further downwardly toward the closure body deck 28. When the force is released from the nozzle assembly actuating portion 69, the biasing means curved members 101 tend to spring upwardly and force the nozzle assembly 60 to the closed position illustrated in FIG. 4.

Figure 6:
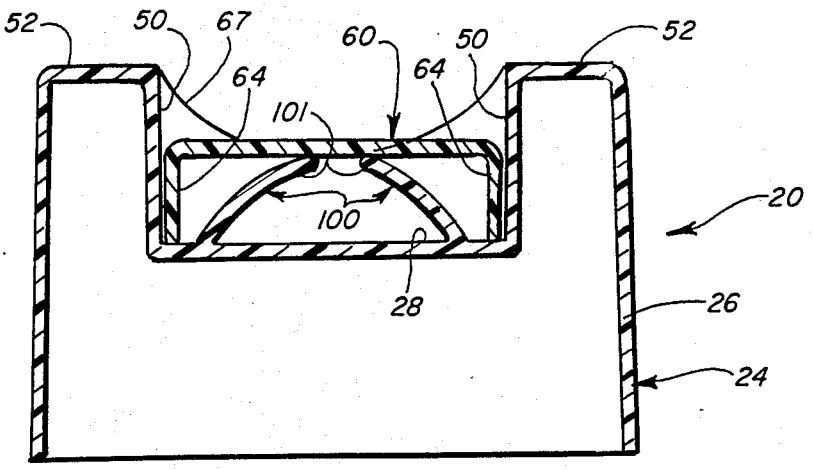
FIG. 6 is a cross-sectional view taken along the plane 6—6 in FIG. 3.
Figure 7:
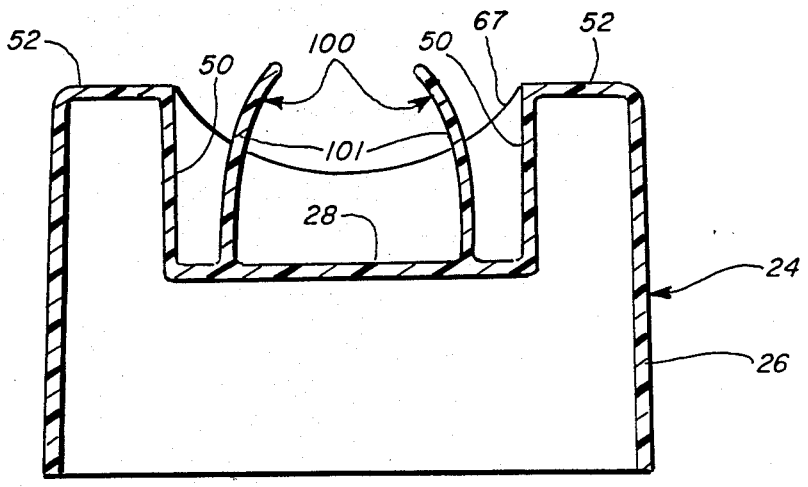
FIG. 7 is a view similar to FIGS. 5 and 6, but showing the nozzle assembly completely removed from the closure body.

As best illustrated in FIG. 6, the curved members 101 of the biasing means 100 are subjected to a maximum deflection when the dispensing nozzle assembly 60 is tilted fully to its dispensing orientation, and the curved members 101 of the biasing means 100 are deflected to a lesser extent when the nozzle assembly 60 is in the closed position. Nevertheless, even in the closed position, the free ends of the curved members 101 of the biasing means 100 engage the nozzle assembly 60. To ensure that such engagement exists in the closed position to provide a continuous urging or biasing of the nozzle assembly 60 to the closed position, the curved members 101 of the biasing means 100 are fabricated so that, before the nozzle assembly 60 is mounted to the closure body 24, the distal free ends of the curved members 101 extend above the closure body top wall 52 in the completely undeflected condition.

Preferably, the curved members 101 of the biasing means 100 are fabricated as an integral or unitary part of the closure body 24. The closure body 24 may be fabricated from a thermoplastic polymer, such as polypropylene, and the curved members 101 of the biasing means 100 can be molded as unitary portions of the closure body 24 in the undeflected configuration illustrated in FIG. 7.

Figure 8:
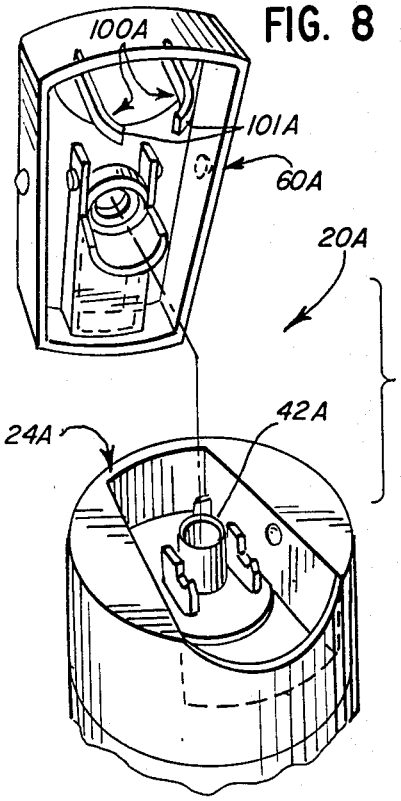
FIG. 8 is a fragmentary, exploded perspective view of a second embodiment of the closure of the present invention.
Figure 9:
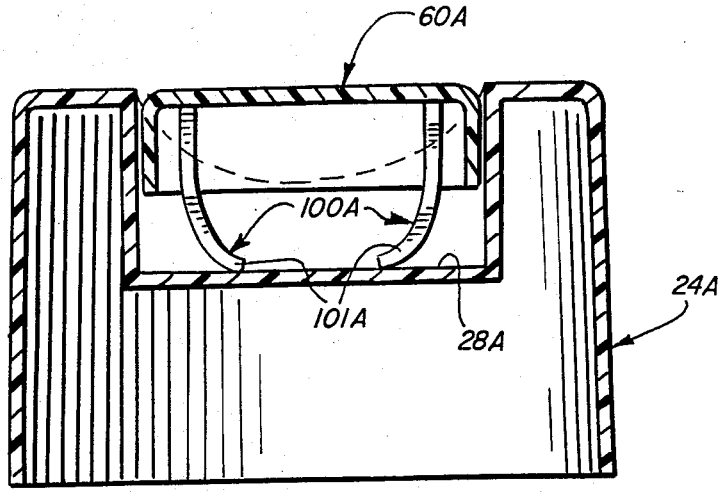
FIG. 9 is a greatly enlarged, cross-sectional view similar to FIG. 5, but showing the second embodiment of the closure in the closed position.

The second embodiment of the closure is illustrated in FIGS. 8 and 9 and is designated generally therein by reference numeral 20A. The closure 20A is similar, and functions in a similar manner, to the first embodiment of the closure 20 described above with reference to FIGS. 1–7. The elements of the second embodiment of the closure 20A that are identical or functionally analogous to those of the first embodiment of the closure 20 are designated by reference numerals identical to those used for the first embodiment with the exception that the second embodiment reference numerals are followed by the upper case letter A.

In the second embodiment, the biasing means 100A comprises two curved members 101A projecting downwardly from the underside of the nozzle assembly 60A. Each curved member 101A has a distal free end engaging the top of the closure body deck 28A. The curved members 101A are engaged with the deck 28A when the nozzle assembly 60A is in the closed position (illustrated in FIG. 9) as well as when the nozzle assembly 60A is in the open position (not illustrated, but analogous to the open position illustrated for the first embodiment in FIGS. 3 and 6).

Figure 10:
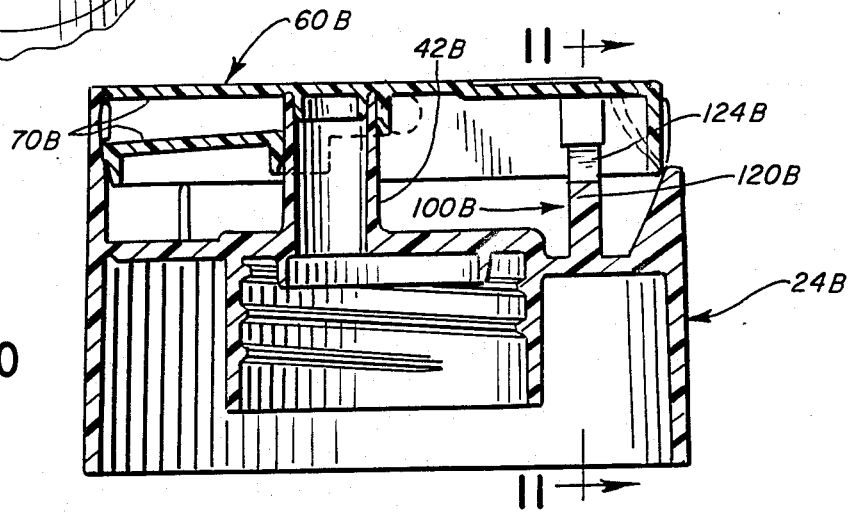
FIG. 10 is a cross-sectional view similar to FIG. 4, but showing a third embodiment in the closed position.
Figure 11:
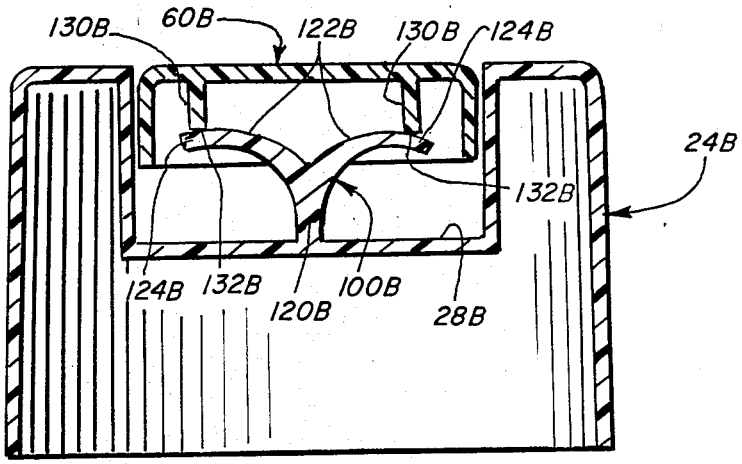
FIG. 11 is a cross-sectional view of the third embodiment taken along the plane 11—11 in FIG. 10.

The third embodiment of the closure is illustrated in FIGS. 10 and 11 and is designated generally therein by reference numeral 20B. The closure 20B is similar, and functions in a similar manner, to the first embodiment of the closure 20 described above with reference to FIGS. 1–7. The elements of the third embodiment of the closure 20B that are identical or functionally analogous to those of the first embodiment of the closure 20 are designated by reference numerals identical to those used for the first embodiment with the exception that the third embodiment reference numerals are followed by the upper case letter B.

In the third embodiment, the closure body 24B includes a biasing means 100B having a stem portion 120B extending upwardly from the deck 28B and two branch portions 122B diverging from the top of the stem portion 120B. Each branch portion 122B defines a free end portion 124B (FIG. 11).

The nozzle assembly 60B includes downwardly depending bearing flanges 130B which each have a downwardly facing flat face 132B. Each face 132B is engaged by a free end portion 124B of the biasing means 100B. In this manner, the nozzle assembly 60B is continuously urged toward the closed position as illustrated in FIGS. 10 and 11. Application of a force on the rear portion of the nozzle assembly 60B will depress, and further deflect, the biasing means branch portions 122B as the nozzle assembly 60B pivots to the tilted, dispensing orientation (analogous to that illustrated for the first embodiment in FIG. 3).

The fourth embodiment of the closure is illustrated in FIGS. 12–14 and is designated generally therein by reference numeral 20C. The closure 20C is similar, and functions in a similar manner, to the first embodiment of the closure 20 described above with reference to FIGS. 1–7. The elements of the fourth embodiment of the closure 20C that are identical or functionally analogous to those of the first embodiment of the closure 20 are designated by reference numerals identical to those used for the first embodiment with the exception that the fourth embodiment reference numerals are followed by the upper case letter C.

In the fourth embodiment, the closure body 24C defines a cavity 130C which extends downwardly from the deck 28C. In particular, the cavity 130C in the closure body 24C is defined by a downwardly slanting front surface 160C, a downwardly slanting rear bearing surface 164C, and two downwardly slanting side bearing surfaces 168C.

The nozzle assembly 60C includes a biasing means 100C in the form of a pair of downwardly depending spring members 101C. Each spring member 101C engages one of the downwardly slanting side bearing surfaces 160C as well as the downwardly slanting rear bearing surface 164C. Since the bearing surfaces 160C and 164C of the cavity 130C slant inwardly, the spring members 101C are increasingly deflected as the rear of the nozzle assembly 60C is pushed downwardly to tilt the nozzle assembly 60C to the dispensing orientation. This results in an increased reaction force acting through the spring members 101C to urge the nozzle assembly 60C toward the closed position.

In all of the embodiments of the dispensing closure of the present invention, the structure for effecting automatic closing of the dispensing closure is enclosed within the closure so that the structure is not visible and so that the structure is protected to some extent from the outside environment. The structure for effecting the closing of the dispensing closure can be readily fabricated from thermoplastic materials as a unitary part of either the nozzle assembly or of the closure body.

As a result of the illustrated two-piece construction that is possible with the present invention, the nozzle assembly may be fabricated from a material having a different color than the material used for fabricating the closure body.

It will be readily observed from the foregoing detailed description of the invention and from the illustrated embodiments thereof that numerous variations and modifications may be effected without departing from the true spirit and scope of the novel concepts or principles of this invention.

What is claimed is:

1. A self-closing, press-to-open, dispensing closure for a container for flowable material, said closure comprising:

a closure body for the top of said container and a nozzle assembly carried by said closed body;

said closure body having means for mounting said closure body on said container and a deck for extending across at least a portion of the container top, said closure body further having a discharge tube projecting upwardly from said deck, said tube communicating through said deck with said container interior and having an upper end defining a discharge opening, and said closure body further having a pivot support means for pivotably supporting said nozzle assembly about a pivot axis above said deck;

said nozzle assembly including (1) a forwardly projecting nozzle adjacent said discharge tube opening, (2) a rearwardly projecting actuating member above said deck, and (3) engaging pivot means for engaging said pivot support means to accommodate pivoting movement of said nozzle assembly about said pivot axis between a closed position occluding said discharge tube opening and an open position permitting flow of said material out of said discharge tube opening and through said nozzle, said nozzle assembly actuating member including a pair of spaced-apart downwardly depending bearing members, each said bearing member having a downwardly facing flat face defining a bearing surface; and a resilient biasing member projecting from said deck, said biasing member including a stem portion extending upwardly from said deck and two branch portions diverging from said stem portion, each said branch portion defining a distal free end, each said actuating member bearing surface being engaged with one of distal free ends of said biasing member when said nozzle assembly is in said closed position as well as in said open position whereby said biasing member urges said nozzle assembly toward said closed position.

* * * * *

UNITED STATES PATENT AND TRADEMARK OFFICE

CERTIFICATE OF CORRECTION

PATENT NO. : 4,776,501

DATED : October 11, 1988

INVENTOR(S) : Efrem M. Ostrowsky

It is certified that error appears in the above-identified patent and that said Letters Patent is hereby corrected as shown below:

In the claims:

Column 7, line 34, change "closed" to --closure--.

Signed and Sealed this

Twenty-first Day of March, 1989

*Attest:*

DONALD J. QUIGG

*Attesting Officer*

*Commissioner of Patents and Trademarks*